United States Patent [19]

Herrera

[11] Patent Number: 4,769,626

[45] Date of Patent: Sep. 6, 1988

[54] POSITIVE FEEL VARIABLE RESISTANCE SWITCH

[75] Inventor: Victor Herrera, Walled Lake, Mich.

[73] Assignee: United Technologies Automotive, Inc., Dearborn, Mich.

[21] Appl. No.: 69,065

[22] Filed: Jul. 2, 1987

[51] Int. Cl.[4] ..... H01C 10/46

[52] U.S. Cl. ..... 338/185; 338/162

[58] Field of Search ..... 338/126, 127, 140, 155, 338/162, 185, 175, 191, 198, 200, 201, 260, 320

[56] References Cited

U.S. PATENT DOCUMENTS

| | | | |
|---|---|---|---|
| 311,820 | 2/1885 | Doyle | 338/200 X |
| 2,151,037 | 3/1939 | Krieger | 338/191 X |
| 4,451,715 | 5/1984 | Neese | 200/11 G |
| 4,599,501 | 7/1986 | Migrin | 200/156 |
| 4,613,733 | 9/1986 | Migrin et al. | 338/191 X |

FOREIGN PATENT DOCUMENTS

| | | | |
|---|---|---|---|
| 770810 | 7/1934 | France | 338/191 |

*Primary Examiner*—C. L. Albritton

[57] ABSTRACT

A variable resistance switch utilizing a resistor network (40) and discrete electrical contacts. A thumbwheel position selector (50) having a detent follower (58) co-acting with a series of detents (22) is utilized by an operator to feel the detent follower index between detents as the thumbwheel switch is rotated. Electrical contacts are made with discrete inputs to a resistor network for selecting a discrete resistance value based upon the position of the thumbwheel.

10 Claims, 1 Drawing Sheet

POSITIVE FEEL VARIABLE RESISTANCE SWITCH

TECHNICAL FIELD

The field to which this invention pertains is the field of electrical switches and, specifically, variable resistance switches.

BACKGROUND OF THE INVENTION

The present invention is directed to a variable resistance switch having a plurality of discrete resistance values and which provides a positive feel to the operator as the switch is manually indexed between the values.

Previous dimmer switches, such as those used in automobiles, have utilized a resistance material painted or deposited on a substrate and a pair of wiper arms which were rotated along the resistance material. In this manner, the length of the resistance material generating the resistance value was varied to effect control of the dimming of the lights in the automobile.

However, it has been found that the painted on material may become dirty thereby degrading the electrical contact between the wiper arm and the material or the resistance material may actually erode by mechanical contact with the wiper arm thereby providing dead spots beyond the erosion location. Once the material becomes scratched or contact is less than perfect due to uncleanliness, the switch may essentially become inoperative. Additionally due to the length of the device and since the electrical connection is dependent upon the location where a pair of wiper arms make contact with the resistance material, the linearness of the overall device is in question.

The use of a resistor network as provided herein provides for enhanced control of the dimming function. A thick film resistor network having sufficient electrical resistance to dim the interior lights of an automobile is used. The resistor network may be of variable thickness and sizes and may be wave soldered to a printed circuit board. Custom resistance values are values that are accomplished by laser trimming the resistor network, thus the dimming characteristics can be precisely controlled either to be linear or nonlinear.

Additionally providing a resistor network with discrete steps enhances reliability, stability, accuracy, and most importantly, repeatability of the networks ensures uniformity from switch assembly to switch assembly. Conventional printed resistors or potentiometers exhibit only some of these traits and may have flat or dead spots which are undesirable.

Additionally, the sensitivity of customary resistors can be designed out of the switch using the resistor network. By providing for discrete energization of various portions of the resistor network, the electrical performance of the switch becomes highly repeatable. Furthermore, a positive feel may be provided to the operator by the provision of a series of mini-detents which transmit positive feedback to the operator as the switch is indexed. The use of the mini-detents may also be coordinated with the separate discrete values of the resistor network such that the operator may feel the detent follower index from detent to detent as the switch is indexed from detent to detent and as simultaneously the resistor network is indexed between values. Hence, a particular detent may be aligned with a particular resistance value such that as the switch is rotated to that detent, the appropriate electrical contacts are made to obtain the desired resistance value. Hence, the positioning of the switch may be repeated from switch to switch and is not dependent upon the accuracy and thickness of a deposited, painted on layer of resistance material.

U.S. Pat. No. 4,613,733 describes a delay wiper switch using a resistance network. This patent, which is commonly assigned with the herein application, discloses the use of a resistor network for determining selected resistance values for use in controlling windshield wipers. This patent although disclosing a detent mechanism does not disclose a detent mechanism for indexing between the various resistance values of the resistance network.

SUMMARY OF THE INVENTION

It is an object of the present invention to provide a variable resistance switch.

It is a further object of the present invention to provide a switch having a series of sequentially ordered resistance values and means for making appropriate electrical connections therewith.

It is another object of the present invention to provide a detent mechanism in combination with a resistor network for selectively indexing between appropriate resistance values.

It is a still further object of the present invention to provide a manually displaceable variable resistance switch having a positive feel so that the operator may determine the appropriate location of the electrical contacts and the resistance value thereby selected.

It is a still further object of the present invention to provide a safe, economical, reliable, easy to manufacture and assemble switch having repeatable electrical characteristics.

Other objects will be apparent from the description to follow and the appended claims.

The above objects are achieved according to the preferred embodiment of the invention by the provision of a variable resistance switch. The variable resistance switch includes a rotatable thumbwheel mounted for rotary motion and including a detent follower. A contactor is mounted to the thumbwheel and includes contacts for making electrical connections. Also disclosed is a detent block having a preselected pattern of detents, said detent block being positioned relative to the detent followers such that the detent follower sequentially indexes between detents as the thumbwheel is rotated. A circuit board means having a series of circuit board electrical contacts and being mounted to be engaged by projecting contacts to the contactor, such circuit board contacts being arranged such that as the thumbwheel is rotated and the detent follower is indexed between detents, the contacts of the contactor engage different circuit board contacts. A resistor network is included having a series of leads, said resistor network having discrete resistance values depending upon which leads are energized, and said leads being connected to the circuit board means whereby rotation of the thumbwheel indexes the detent follower between detents and the contactor makes distinct electrical connections dependent upon which detent is receiving the detent follower.

Also disclosed is a dimmer switch having discrete resistance values and which provides a positive feel to the operator which includes a resistor network having a plurality of inputs for developing distinct resistance values across the network, a manually operated dimmer position selector including a detent follower means, a detent block defining a plurality of detents positioned to receive the detent follower means, and electrical contact means connected to the position selector, said contact means acting to make the electrical connection to a particular input to the resistor network depending upon in which detent the detent follower means is located whereby as the position selector is indexed between detents, the electrical contact means is indexed between inputs to the resistor network and whereby the opertor may feel the detent follower means index between detents.

PREFERRED EMBODIMENT OF THE INVENTION

The herein invention will be described with reference to a particular embodiment designed for use as a thumbwheel driven interior or dashboard light dimmer switch for a motor vehicle. It is to be understood that this invention has like applicability to other types of variable resistance switches. It is further to be understood that although thumbwheel driven is a preferred embodiment, other types of switches could likewise serve the intended function.

Figure 1:
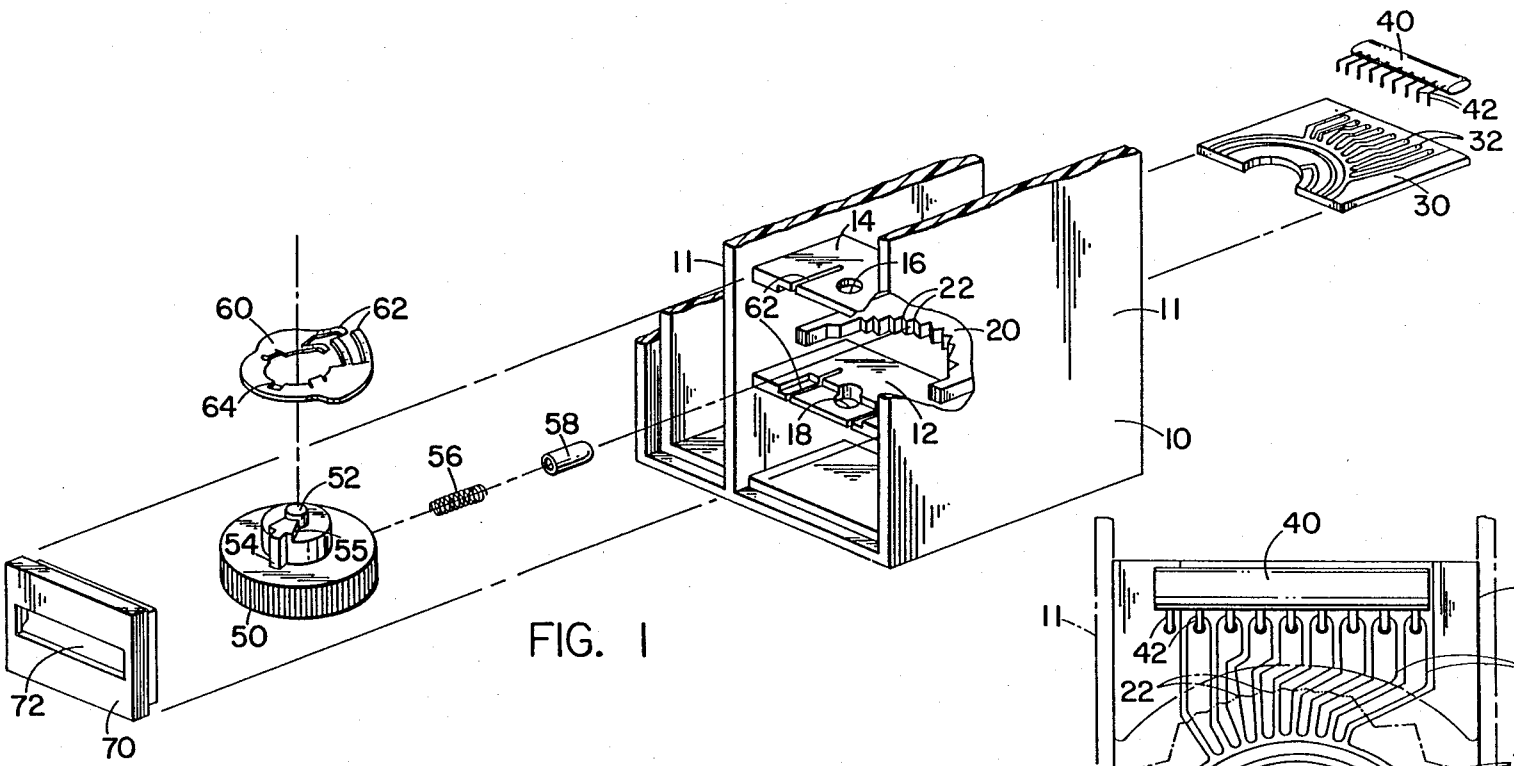
FIG. 1 is an exploded view of a variable resistance switch mechanism.

Referring first to FIG. 1, there may be seen an exploded view of the switch mechanism having a portion of housing 10 cutaway. Within housing 10 having side walls 11 are horizontally extending supports 12 and 14 each of which has an opening 18 and 16 respectively. Detent block 20 is shown between two supports and defines a series of detents 22 about the perimeter thereof. Flex slots 62 are shown in supports 12 and 14. These flex slots make the supports more flexible thereby promoting easy assembly and disassembly of the thumbwheel thereto.

Thumbwheel 50 having shaft 52, key 54, and limit stop 55 is shown positioned to be mounted with the shaft extending into openings 18 and 16 such that the thumbwheel may be mounted for relative rotational displacement. Limit stop 55 contacts the edge of support 12 to limit the rotational displacement of the thumbwheel. Detent follower 58 extends from an opening (not shown) in thumbwheel 50. Spring 56 is mounted within the detent follower and opening to bias the detent follower away from thumbwheel 50. When assembled, the detent follower engages detents 22 and may be indexed from detent to detent as the thumbwheel is rotated. The operator of the thumbwheel will feel the contact of detent follower 58 as it passes over the ridges between the various detents such that the operator may determine the relative position of the thumbwheel by either counting the positions of the detent follower or by estimating position based on the relative feel of the thumbwheel.

Front cover 70 having a thumbwheel slot 72 is shown for mounting to housing 10. When assembled, thumbwheel 50 extends slightly through the thumbwheel slot such that an operator may engage the extending portion of the thumbwheel to rotationally move it.

Contactor 60 is shown positioned to be mounted to thumbwheel 50 and defines a central opening including key slot 64. Key slot 64 mates with key 54 of the thumbwheel to maintain the desired relative rotational positioning between contactor 60 and thumbwheel 50. As a portion of contactor 60, contacts 62 project upwardly and are positioned to make appropriate electrical contact with printed circuit board 30.

Printed circuit board 30 is shown having a resistor network 40 with extending leads 42 mounted thereto. Printed circuit board 30 may be mounted to the bottom of support 14 such that contacts 62 from contactors 60 are in engagement with the various conductor runs or contacts of the printed circuit board to make the desired electrical connections.

Figure 2:
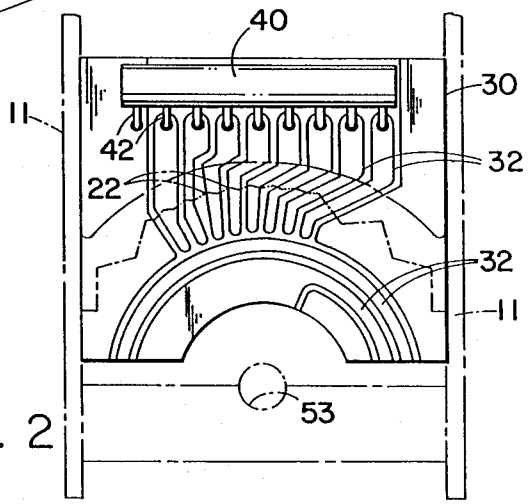
FIG. 2 is a bottom view of a printed circuit board with appropriate detents shown in phantom.

Referring more specifically to FIG. 2, there may be seen a diagram of the conductor runs of a printed circuit board 30. Conductor runs 32, which may be the contacts or may be connected to the contacts, are shown extending one to each lead or input to resistor network 40. Conductor runs for other purposes are additionally shown. Shaft position 53 is shown to indicate where shaft 52 of the thumbwheel will be located. Contacts 62 as they extend from contactor 60 will engage the appropriate one or more of the conductor runs 32 for making the appropriate electrical connections. Side walls 11 are shown to which the printed circuit board 30 is mounted.

Also shown in phantom are detents 22. It is through these detents that the detent follower 58 is indexed. It can be seen that as the detent follower 58 moves from detent to detent, the contacts 62 will be rotated to make appropriate connection with conductor runs 32. In this manner, it will be seen that the detent follower will index from detent to detent, and as it does, contacts 62 will index from conductor run to conductor run. In this manner, the discrete resistance values of the resistor network may be selected one at a time as the detent follower is indexed between positions.

Also it can be seen that as the detent follower indexes from position to position, the operator of the thumbwheel will feel the detent follower so index, and hence will know which resistance value is being selected by the appropriate electrical contacts being made for that detent position. Hence, the operator receives a positive feel as to which resistance value to select to obtain the desired dimming of the lights or other functional output connected to the variable resistance value. Additionally, by the use of the resistor network and the discrete values obtained by making electrical connections to the conductor runs rather than to a resistor material, it is possible to maintain repeatable performance from switch to switch such that the mass production of the switches may result in identical switches having substantially identical resistance values for each thumbwheel location. Additionally, the testing of switches may be standardized since the positioning of the conductor runs and the discreteness of the resistor network are now established.

The invention has been described with reference to a particular embodiment, however, it is to be understood by those skilled in the art that variations and modifications can be effected within the spirit and scope of the invention.

I claim:

1. A variable resistance switch which comprises:

a rotatable thumbwheel mounted for rotary motion about an axis including a detent follower mounted for radial motion relative to said axis;

a contactor mounted to the thumbwheel and including projecting contacts for making electrical connections;

a detent block having a preselected pattern of detents formed in an arcuate pattern defined by a radius about the thumbwheel axis and said detents extending in an axial direction, said detent block being positioned relative to the detent follower such that the detent follower sequentially indexes between detents as the thumbwheel is rotated;

a circuit board means having a series of circuit board electrical contacts, said circuit board means being mounted to be engaged by the projecting contacts of the contactor and, said circuit board contacts being arranged such that as the thumbwheel is rotated and the detent follower is indexed between detents, the contactor contacts engage different circuit board contacts; and a resistor network having a series of leads, said resistor network having discrete resistance values dependent upon which leads are energized, said leads being connected to the circuit board means whereby rotation of the thumbwheel indexes the detent follower between detents and the contactor makes distinct electrical connections dependent upon which detent is receiving the detent follower.

2. The apparatus as set forth in claim 1 wherein the circuit board means further comprises an electrical contact for each lead of the resistor network, and wherein each lead is connected by a conductor run on the circuit board means to the appropriate contact.

3. The apparatus as set forth in claim 2 wherein the preselected pattern of detents further comprises sequential detents, one per electrical contact, whereby rotation of the thumbwheel sequentially indexes both the detent follower from detent to detent and the contactor from electrical contact to electrical contact, each position of the thumbwheel as determined by the detent follower having a different electrical contact.

4. The apparatus as set forth in claim 1 and further comprising the thumbwheel including a key, the contactor including a key slot sized to mate with the key, and the contactor having projecting contacts for making electrical connections.

5. A dimmer switch having discrete resistance values and which provides a positive fee to the operator which comprises:

a resistor network having a plurality of inputs for developing distinct resistance values across the network;

a rotable manually operated dimmer position selector having an axis of rotation including a detent follower means positioned to extend in a radial direction from the axis of rotation, said detent follower means being displaceable in the radial direction and including a spring means biasing the detent follower means in the radially outward direction;

a detent block defining a plurality of detents arranged in an arcuate pattern about the axis of rotation of the dimmer position selector and extending in a plane parallel to the axis of rotation of said dimmer position selector and positioned to receive the detent follower means; and electrical contact means connected to the position selector, said contact means acting to make an electrical connection to a particular input to the resistor network depending upon in which detent the detent follower means is located whereby as the dimmer position selector is indexed between detents the electrical contact means is indexed between inputs to the resistor network and whereby the operator may feel the detent follower means index between detents.

6. The apparatus as set forth in claim 5 wherein the detent block includes a detent corresponding to each of the inputs to the resistor network and wherein the electrical contact means includes means to make an electrical connection to each of the inputs when the detent follower is located in the appropriate detent.

7. The apparatus as set forth in claim 1 and further comprising the electrical connections being arranged in sequential order such that the resistance value being generated sequentially increases or decreases as the position selector is indexed along the detent block.

8. The apparatus as set forth in claim 6 wherein there is one detent for each input to the resistor network.

9. The apparatus as set forth in claim 1 wherein the position selector comprises a thumbwheel.

10. The apparatus as set forth in claim 9 wherein the electrical contact means comprises a rotating contactor mounted to the thumbwheel and a printed circuit board having patterns of contacts and conductor means connected between the contacts and the inputs to the resistor network, whereby said contactor may be rotated to make electrical connection to the various contacts.

* * * * *